US007004823B2

(12) United States Patent
Kisbøll et al.

(10) Patent No.: US 7,004,823 B2
(45) Date of Patent: Feb. 28, 2006

(54) MULTI-ZONE GRINDING AND/OR POLISHING SHEET

(75) Inventors: Klaus Kisbøll, Virum (DK); Morten J. Damgaard, Store Merløse (DK)

(73) Assignee: Struers A/S, Rodovre (DK)

( * ) Notice: Subject to any disclaimer, the term of this patent is extended or adjusted under 35 U.S.C. 154(b) by 139 days.

(21) Appl. No.: 10/297,835

(22) PCT Filed: Apr. 30, 2001

(86) PCT No.: PCT/DK01/00291

§ 371 (c)(1),
(2), (4) Date: Dec. 11, 2002

(87) PCT Pub. No.: WO01/98027

PCT Pub. Date: Dec. 21, 2001

(65) Prior Publication Data

US 2004/0048552 A1 Mar. 11, 2004

(30) Foreign Application Priority Data

Jun. 19, 2000 (DK) ..... 2000 00950

(51) Int. Cl.
*B24B 1/00* (2006.01)

(52) U.S. Cl. ..... 451/57; 451/529; 451/548; 451/461

(58) Field of Classification Search ..... 451/57, 451/461, 529, 548; 15/228, 4, 230, 230.16
See application file for complete search history.

(56) References Cited

U.S. PATENT DOCUMENTS

| | | | | | |
|---|---|---|---|---|---|
| 959,054 | A | * | 5/1910 | Glover | 451/530 |
| 2,451,295 | A | * | 10/1948 | Metzger et al. | 451/548 |
| 3,026,655 | A | * | 3/1962 | Osenberg | 451/548 |
| 4,037,369 | A | * | 7/1977 | Campbell | 451/532 |
| 4,481,741 | A | | 11/1984 | Bouladon et al. | |
| H000244 | H | * | 4/1987 | Goodwin | 451/57 |
| H000361 | H | * | 11/1987 | Goodwin | 451/57 |
| 5,247,765 | A | * | 9/1993 | Quintana | 451/548 |
| 5,527,215 | A | | 6/1996 | Rubino et al. | |
| 5,534,106 | A | | 7/1996 | Cote et al. | |
| 5,951,380 | A | | 9/1999 | Kim | |
| 6,019,672 | A | * | 2/2000 | Damgaard | 451/527 |
| 6,062,958 | A | | 5/2000 | Wright et al. | |
| 6,083,085 | A | | 7/2000 | Lankford | |
| 6,163,954 | A | * | 12/2000 | Nakagawa | 29/603.12 |
| 6,461,226 | B1 | * | 10/2002 | Yi | 451/41 |

FOREIGN PATENT DOCUMENTS

| | | |
|---|---|---|
| EP | 0860237 | 8/1998 |
| EP | 0878270 | 11/1998 |
| JP | 5914469 | 1/1984 |
| WO | 9607508 | 3/1996 |
| WO | 9828108 | 7/1998 |
| WO | 9928083 | 6/1999 |
| WO | 0034008 | 6/2000 |

OTHER PUBLICATIONS

Patent Abstracts of Japan, English Summary of JP 59–14469.
Patent Abstracts of Japan, English Summary of JP 2000176829.

* cited by examiner

*Primary Examiner*—George Nguyen
(74) *Attorney, Agent, or Firm*—Dykema Gossett PLLC

(57) ABSTRACT

The invention relates to grinding/polishing sheet, which comprises 2 or more annular grinding/polishing zones (1–5) separated by intermediate annular distancing zones (6). One or more of the grinding polishing zones (1–5) comprises one or more non-continuous areas, that are part of an annular structure forming channels (8) in radial direction. The grinding/polishing sheet can be placed on a rotatable grinding/polishing disc for manual, automatic or semiautomatic preparations of materialographic samples. The invention also relates to a method for preparations of materialographic samples.

29 Claims, 9 Drawing Sheets

MULTI-ZONE GRINDING AND/OR POLISHING SHEET

BACKGROUND OF THE INVENTION

1. Field of the Invention

The present invention relates to a cover sheet for placing on a rotatable grinding/polishing (treatment) disc for manual, automatic or semiautomatic preparations of materialographic samples. The invention also relates to a method of performing preparation of a materialographic sample using one or more cover sheets.

2. The Prior Art

The preparation of materialographic samples, e.g., metallographic, petrographic and ceramographic samples, is usually performed by use of a rotatable grinding/polishing disc covered with a grinding/polishing sheet. The preparation is normally performed in 3 or more steps, viz. one or more plane grinding steps, one or more fine grinding steps, and one or more polishing steps.

Traditional grinding sheets also designated cover sheets, contain an abrasive material incorporated into the surface adapted to be brought into contact with the sample to be treated. A very used type of cover sheet consists of a paper or paper-like substrate onto which abrasive particles are adhered. The main drawback of this sheet type is, that it has a very short lifetime and needs to be exchanged very often, which requires a lot of work.

Some of the cover sheets employed today are not in themselves abrasive, but serve as a substrate for an abrasive grinding/polishing agent, which is sprayed or otherwise applied onto the surface of the cover sheet, either automatically or manually before or under the grinding/polishing process.

Cover sheets in the form of metal support plates covered with hard coatings consisting of a composite material, e.g. of epoxy with hard particles of one or more metals or ceramic particles embedded therein are also well known. In the prior art, cf. e.g. DK 143096, such coatings are moulded on or glued to a self-supporting rigid plate, e.g. in the form of mutually separated segments, where after the surface of the coatings is straightened by turning and/or grinding. In this manner a tool is formed, which can be mounted as grinding/polishing disc in a grinding/polishing apparatus.

WO 96/07508 publication discloses a similar cover sheet consisting of a thin foil, which is relatively stiff and onto which a hard composite material has been applied through a stencil in a desired thickness and pattern.

When performing preparation of materialographic samples using prior art grinding/polishing sheets as described above, the operator must in the first plan grinding step use a first cover sheet containing incorporated abrasive particles in order to remove sufficient material relatively fast to make the surface plan. Thereafter, for the fine grinding of the samples, he may use a non-abrasive cover sheet together with an abrasive grinding agent or he may use a cover sheet containing incorporated abrasive particles with has a smaller size than the abrasive particles in the first cover sheet. In case the cover sheets used for the fine grinding procedure is in the form of SiC paper with incorporated abrasive particles, he will need to employ several fine grinding step with progressively finer grain sizes e.g. 2–4 fine grinding step, and in each of these fine grinding step he need to use several sheets due to weak durability,. In the polishing step, he should replace the cover sheet with a cover sheet adapted for polishing in combination with the use of a polishing agent. If the sample should have a very fine polished surface e.g. an oxide polished surface, he will need to change the sheet once more and replace it with a cover sheet adapted for performing an oxide polishing.

As it appears, the operation is very time-consuming, and it is very expensive to construct an apparatus, which automatically can propagate the samples due to the many shifts of cover sheets. If the preparation is conducted manually, it is very time-consuming for the operator due to the exchange of cover sheets or the operator may use several rotatable discs, one for each sheet. Generally, it is an expensive solution to use several rotatable discs.

U.S. Pat. No. 959,054 describes a cover sheet containing abrasive material to one of its surfaces. The abrasive on the sheet is of different degree of fineness varying gradually and uniformly from coarser abrasive material at the centre, to finer abrasive material at the outer edge.

When using this cover sheet, the article to be treated is placed against the sheet near its centre and gradually moved towards the outer edge. The main drawback of using this sheet is that the abrasive material is worn of as the grinding process is performed. Some of the larger abrasive particles worn out of the sheet from near its centre will be incorporated into the sheet or be grabbed by the smaller abrasive particles closer to its outer edge, and consequently, be an obstruction of a polishing of a sample, because these coarser particles will create unwanted grinding scratches in the sample. Generally, it is almost impossible to control the grinding/polishing procedure because the abrasive materials after the procedure is initiated will be more or less mixed op with each other. Another drawback is that the sheet mainly will be worn in the annular centre portion of each abrasive zone, which means that it can only be used for a very short time before a height difference is created. Such height difference in the abrasive material may result in an uneven grinding and polishing of the samples, which is highly unwanted. As a consequence of these many drawbacks of the cover sheet described in U.S. Pat. No. 959,054, this sheet has never been commercialised.

The objective of the present invention is to provide a grinding/polishing cover sheet, by which the drawbacks of the previously known cover sheets are avoided.

It is particular an object of the invention to provide a grinding/polishing cover sheet by use of which, the numerous changes of cover sheets during a process of preparation of a materialographic sample can be reduced or avoided, and particularly, it is an objective to provide a cover sheet by use of which two or more grinding/polishing steps can be performed without any substantial risk of contaminating abrasive materials from a first grinding/polishing step to a second grinding/polishing step under performing of this second step.

Another objective of the present invention is to provide a grinding/polishing cover sheet, which can be easily used without the risk of creating height differences in the surface of the sheet, which might result in creating the surface of a sample uneven.

Yet a further objective of the present invention is to provide a method of grinding/polishing a sample in two or more steps using one single cover sheet, by use of which method the risk of contaminating abrasive materials from a first grinding/polishing step to a second grinding/polishing step under performing of this second step is substantially eliminated.

SUMMARY OF THE INVENTION

It has been found that by use of the grinding/polishing (treatment) sheet according to the invention, abrasive material from a first grinding/polishing zone does not result in any substantial contamination of a second grinding/polishing zone, in particular not when the second grinding/polishing zone is placed closer to the centre of the sheet than said first zone. The channels between the grinding/polishing zones create barriers between juxtaposed grinding/polishing zones, which particularly prevent the transportation of abrasive material to other zones and in particular to other zones lying closer to the centre of the sheet than the zone where the abrasive material is placed or incorporated.

The grinding/polishing sheet according to the invention may in principle have an unlimited number of annular concentric grinding/polishing zones. However, due to the size of the sheet, it is preferred that the number of grinding/polishing zones is between 2 and 6. Mostly, it is preferred that the sheet has 2, 3 or 4 grinding/polishing zones. The term annular zone also encompasses a zone with circular shape, which e.g. may be placed in the centre of the grinding/polishing sheet.

The grinding/polishing sheet is to be understood as a carrier medium, which during operation is attached to a rotating disc with one of its sides. On the opposite side the grinding/polishing sheet has the grinding/polishing zones attached. The side of grinding/polishing sheet with the grinding/polishing zones is referred to as the face side of the grinding/polishing sheet.

According to the invention a sample is only treated on one grinding/polishing zone at the time, thereby avoiding grinding/polishing material and waste being transported from one zone to another during treatment of a sample.

The diameter of the sheet may preferably be between 200–500 mm, more preferably between 300–400 mm, however, it will be obvious to the skilled person that the sheet may have any size as long as it is possible to rotate the sheet on a rotatable disc.

The sheet is preferably made from a base layer or support sheet, having a substantially plane first surface onto which surface the grinding/polishing zones are applied. The base layer may in general be made of any type of materials, which can withstand a grinding/polishing process e.g. metal, impregnated woven or non-woven tissue, cardboard, plastic, such as plastic with incorporated glass fibres or metal particles etc.

The second surface of the base layer is adapted to be applied onto a rotatable abutment in a grinding apparatus. For this application, it is normally required that this second surface of the base layer is substantially plane.

In order to facilitate a temporary fixation of the cover sheet according to the invention to a magnetized movable abutment in a grinding apparatus, it is preferred that the base layer comprises ferromagnetic material. The ferromagnetic material according to this embodiment can be in any form and be placed anywhere in the base layer, e.g. in terms of ferromagnetic granules incorporated in a polymer liner. However, according to the invention, it is strongly preferred to use a metal foil as base layer, e.g. a foil having a thickness of around 0.05–2 mm.

Alternatively, the cover sheet according to the invention may be provided with a layer of an adhesive material on its second side i.e. the side to be facing the abutment during use in order to provide the necessary temporary fixation to said abutment.

The grinding/polishing zones are applied onto the base layer by use of any suitably means depending on the type of the zone. If the zone is in the form of a resilient tissue, it is preferred to apply the zone by use of an adhesive e.g. as described in FR 2.226.068. If the zone is in the form of separate segments, it may preferably be applied by use of adhesive or through a stencil as described in WO 96/07508. If the zone is in the form of a material having incorporated grains, it may preferably be applied by using an adhesive in the form of a binding agent, which may e.g. be applied using a silk printing method as disclosed in WO 99/08837.

The annular grinding/polishing zones are applied onto the base layer with a distance from each other to thereby create an annular distancing zone in the form of an annular channel between two juxtaposed grinding/polishing zones. This means that a grinding/polishing sheet having 3 annular grinding/polishing zones has 2 annular channels between these grinding/polishing zones and, etc.

It is preferred that each of the annular channels has a depth measured from the lowest point of the channel perpendicular to the face surface, to the plane defined by the upper surface of the grinding/polishing or cleaning zone lying next to the channel and closer to the centre of the sheet than the channel, which is at least 100 $\mu$m. Preferably, at least one, and more preferably all of the channels of the grinding/polishing sheet have a depth of between 0.1 and 3 mm, more preferably between 0.5 and 2 mm.

It has surprisingly been found that these channels in general reduce the risk of transferring grains from one zone to another. In particular, it has been found that these channels when they have depth, which is sufficiently deeper than the average grain size of the grinding grains, which is used during the grinding process, prevent the grains from passing from a first grinding/polishing zone to a second grinding/polishing zone, which is closer to the centre of the grinding/polishing sheet. Thereby, it is possibly to prepare metallographic preparations without any unwanted grain marks on the preparations.

The width of a channel measured as its radial extends should preferably be at least 1 mm, more preferably between 2 and 20 mm, and even more preferably between 4 and 10 mm. In situations where the grinding/polishing sheet contains 2 or more annular channels, the width of the respective channels may vary from each other. However, it is preferred that the width of the annular channels is substantially equal to each other.

The grinding/polishing sheet may preferably comprise between 2 and 6 annular grinding/polishing zones, more preferably 2, 3 or 4 annular grinding/polishing zones. Each of the annular grinding/polishing zones has a grinding or polishing surface in the form of a hard or resilient surface acting as a substrate for a grinding and/or polishing agent or in the form of a surface containing abrasive grains.

The width of the grinding/polishing zones measured as the radial extension of the zones may vary from each other or they may preferably be substantially equal to each other. Preferably, the zones have an equal width of between 10 and 100 mm, more preferably between 15 and 50 mm and even more preferably, between 20 and 35 mm.

In one embodiment it is preferred that a sample to be prepared has a diameter, which is larger than the width of any of the grinding/polishing zones. The entire width of the grinding/polishing zone will then be in contact with the sample to be grinded/polished. Consequently the zones will be applied with a uniform wear. When the diameter of the sample to be treated is larger than any of the grinding/polishing zones the waste material e.g. dirty fluid from the process are easier transported into the channels and away from the grinding/polishing zones.

In an alternative embodiment the diameter of the sample to be treated is smaller than the width of the grinding/ polishing zones. In order to induce a uniform wear on the grinding/polishing zones in this embodiment the sample is swept side to side all over the surface of the grinding/polishing surface. The sweeping will also facilitate the transport of waste material away from the grinding/polishing zones and into the channels between the zones.

The diameter of the sample is normally to be considered the diameter of a circle, as the cross section of the sample to be treated in most cases are circular. The circular cross section area of the sample is in contact with the grinding/polishing zones. If the cross section of the sample is not circular, the diameter is defined as the diameter of a circle having the same cross section area as the sample.

One or more of the grinding/polishing zones may be provided with one or more e.g. 4 transverse channels extending substantially in radial direction across the zones, and e.g. having a width from 1 to 10 mm. The transverse channels may have a depth of between 0.1 and 3 mm, more preferably between 0.5 and 2 mm. These transverse channels in the grinding/polishing zones serve to drain off dirty fluid from the zones into the annular channels or away from the sheet.

In a preferred embodiment, the grinding/polishing sheet further comprises one or more cleaning zones, preferably in the form of a zone having a resilient surface, e.g. provided by applying a zone-shaped textile onto the face side of the sheet. The zone shaped textile may e.g. be in the form of a nappy, bristly or brushed textile material. The zone shaped textile may also be provided with one or more transverse extending substantially in radial direction across the zones, and e.g. having a width from 1 to 10 mm. These transverse channels in the zone shaped textile serve to drain off dirty fluid from the cleaning zone.

The cleaning zones may have a width as described above for the grinding/polishing zones.

In a preferred embodiment the grinding/polishing sheet comprises one cleaning zone, which preferably is at the periphery of the grinding/polishing sheet.

In the following, the innermost grinding/polishing zone is designated, the in radial direction innermost annular grinding/polishing zone; the outermost grinding/polishing zone is designated, the in radial direction outermost annular grinding/polishing zone, or the first grinding/polishing zone. The grinding/polishing zones further, being numbered from the outermost annular grinding/polishing zone to the innermost annular grinding/polishing zone as the first grinding/polishing zone, the second grinding/polishing, and etc.

As it will be clear to the skilled person, the grinding/polishing sheet according to the invention may be designed to be used in one or more or all of the grinding/polishing steps plane grinding steps, one or more fine grinding steps, and one or more polishing and optionally oxide polishing steps.

In a preferred embodiment of the grinding/polishing sheet according to the invention, the in radial direction outermost annular grinding/polishing zone is a grinding zone, by use of which a plane grinding step can be performed, said outermost zone preferably comprises a grinding surface in the form of a surface layer having incorporated abrasive particles e.g. as described in WO 99/08837 or in the form of a substrate for a grinding agent e.g. as described in WO 96/07508. This embodiment may preferably comprise 2 or 3 annular grinding/polishing zones, and furthermore, the in radial direction innermost zone may preferably be a grinding zone by use of which a fine grinding step can be performed. This innermost zone may comprise a grinding surface in the form of a surface layer having incorporated abrasive particles e.g. as described in WO 99/08837 or in the form of a substrate for a grinding agent e.g. as described in WO 96/07508.

Alternatively, the innermost zone in this embodiment may be a polishing zone by use of which a polishing step can be performed. This innermost zone may preferably comprise a polishing surface in the form of a surface layer constituting a substrate for a polishing agent. Such surface layers are generally known in the art, and may e.g. be in the form of a woven or non-woven textile e.g. impregnated with bakelite or similar polymeric materials. Preferably, the polishing surfaces may be constituted by the surface of a textile selected from the group consisting of canvas, linen, velvet and velvety textiles. The textile may e.g. be adhered by use of an adhesive such as hot melt, two component adhesives or solvent based adhesives to the base of the sheet.

In this embodiment wherein the in radial direction outermost annular grinding/polishing zone is a grinding zone, and the in radial direction innermost grinding/polishing zone is a polishing zone, the grinding/polishing sheet should preferably comprise at least 4 grinding/polishing zones. In this embodiment, it is further preferred that the outermost annular grinding/polishing zone is a grinding zone for used in the performance of a plane grinding step, that the second outermost annular grinding/polishing zone is a grinding zone for use in the performance of a fine grinding step, and that the third and fourth outermost annular grinding/polishing zone are polishing zones.

In another preferred embodiment, the grinding/polishing sheet preferably comprises 2 or 3 grinding/polishing zones and preferably the in radial direction outermost annular zone being a polishing zone by use of which a polishing step can be performed. The outermost zone preferably comprising a polishing surface as described above. In this embodiment, it is furthermore preferred that the remaining zone or zones also are polishing zones, wherein the in radial direction innermost zone is a polishing zone by use of which an oxide polishing step can be performed. The innermost zone preferably comprises a polishing surface in the form of a surface layer constituting a substrate for an oxide-polishing agent, as it is well known in the art.

A preferred embodiment of the grinding/polishing sheet according to the invention the sheet further comprises at least one cleaning zone, and it is preferred that each grinding/polishing zone has an associated cleaning zone in the form of the nearest annular channel towards the centre of the grinding zone.

In a particularly preferred embodiment of the grinding/polishing sheet according to the invention one or more of the grinding/polishing zones are releasable attached to the grinding/polishing sheet. The embodiment provides the possibility to design a grinding/polishing sheet with specific desired properties and fast and easy to change those properties on the sheet. Furthermore it is possible to compensate for uneven wear on the different zones. If one zone is worn out and the remaining zones are still useable it is only necessary to replace the worn out zone and not the entire grinding/polishing sheet.

The one or more of the grinding/polishing zones may be releasable attached to the grinding polishing sheet by any known methods of attachment, including use of an adhesive layer, hooks and loops commonly known as Velcro), magnetic force, screws, pins, clips, press studs or vacuum.

In one preferred embodiment the grinding/polishing sheet the grinding/polishing zones has a layer of adhesive applied to the side facing the grinding/polishing sheet.

In an alternative preferred embodiment of the grinding/polishing sheet with releasable grinding/polishing zones a layer of adhesive is applied to all or a part of the grinding/polishing sheet, preferably the adhesive layer is applied in annular patterns corresponding to the annular grinding/polishing zones.

Preferably the layer of adhesive is coated with a cover lining. The cover lining protects the layer of adhesive, when it is not used for attachment of grinding/polishing zones to the grinding/polishing sheet.

The invention also relates to a method of preparation of a materialographic sample or a set of materialographic samples by use of one or more grinding/polishing sheets according to the invention.

A set of samples includes up to 6 samples, preferably 1 to 3 samples assembled in a sample holder. The number of samples which can be treated simultaneously depends on the size of the samples and the width of the individually grinding/polishing zones. If the samples are 25, 30 or 40 mm, which are traditionally sample sizes, it is preferred to treat one sample at the time.

The method according to the invention may be carried out manually, semi-automatically or automatically and includes the steps of:

i) applying a grinding/polishing sheet on a rotatable disc, ii) treating the sample(s) by bringing it/them into contact with the grinding/polishing zones one by one, by starting with the in radial direction outermost grinding/polishing and terminating with the in radial direction innermost grinding/polishing zone; each step of treatment comprises applying a lubricant to the surface of the grinding/polishing zone and optionally applying a grinding or polishing agent to the surface of the grinding/polishing zone;

iii) optionally replacing the grinding/polishing sheet on a rotatable disc, and repeating step ii).

In the first step i), it is preferred to apply a grinding/polishing sheet comprising one or more annular grinding zones for plane grinding the sample or samples. As described above, these zones may comprise a grinding surface as described above. If the zone is in the form of a substrate for a grinding agent, such grinding agent is applied onto the surface of the zone in step ii). Grinding agents are generally known to the skilled person and may preferably be constituted by a dispersion of diamond grains. The grains in the plane grinding step or steps should preferably have an average particle size of between 25 and 100 $\mu$m. If there is more than one plane grinding zone, the grains incorporated or applied in the form of the grinding agent preferably graduate from a lager average size in the first plane grinding zone to smaller average size in the following second or possible third plane grinding zone.

The first applied grinding/polishing sheet may also comprise one or more grinding zones for performing a fine grinding. If the sheet does not contain such zones, the sheet is preferably replaced by another sheet comprising such zones for fine grinding.

The sample(s) is/are now treated by contacting these one or more annular grinding zones for fine grinding the sample or samples. As described above, these zones may as well comprise a grinding surface in the form of a surface layer having incorporated abrasive particles or in the form of a substrate for a grinding agent. If the zone is in the form of a substrate for a grinding agent, such a grinding agent is applied onto the surface of the zone. The grains in the fine grinding step or steps should preferably have an average particle size of between 5 and 20 $\mu$m. If there is more than one fine grinding zone, the grains incorporated or applied in the form of the grinding agent preferably graduate from a larger average size in the first fine grinding zone to a smaller average size in the following second or possible third fine grinding zones.

The first applied grinding/polishing sheet or optionally replacement for it may also comprise one or more polishing zones for performing a polishing step. If the sheet does not contain such zones, the sheet is preferably replaced by a sheet comprising such zones for polishing.

The sample(s) is/are now treated by contacting these to one or more annular polishing zones for polishing the sample or samples. As described above, these zones may as well comprise a polishing surface in the form of a substrate for a polishing agent e.g. a tissue layer. A polishing agent e.g. in the form of a suspension of diamond grains, is applied onto the surface of the zone in step ii). The grains in the polishing step or steps should preferably have an average particle size of 1–4 $\mu$m. If there is more than one polishing zone, the grains applied in the form of the polishing agent preferably graduate from a larger average size in the first polishing zone, to a smaller average size in the following second or possible third polishing zones.

The first applied grinding/polishing sheet or optionally replacement for it may also comprise one or more oxide polishing zones for performing an oxide-polishing step. If the sheet does not contain such zones, the sheet may be replaced by a sheet comprising such zones for oxide polishing.

The sample(s) is/are now treated by contacting these to one or more annular oxide-polishing zones for polishing the sample or samples. As described above, these zones may as well comprise an oxide-polishing surface in the form of a substrate for an oxide-polishing agent e.g. a textile layer. An oxide-polishing agent e.g. in the form of an aqueous suspension of $SiO_2$ and/or $Al_2O_3$ is applied onto the surface of the zone in step ii).

It should be observed that in all the treatment steps ii) a lubricant is applied. Such lubricants are generally known to the skilled person, and may e.g. consist of water and/or ethanol. If the grinding or polishing agent contains water or ethanol this agent may also constitute the lubricant.

It is generally preferred that the sample(s) is/are cleaned between the polishing steps, and preferably also between the grinding steps and polishing steps. This cleaning may be conducted by use of water and/or ethanol preferably by bringing the sample(s) in contact with a textile e.g. a rotatable disk covered with a textile onto which water and/or ethanol are added. The sample(s) is/are slightly pressed against the textile preferably during the continuously addition of water/ethanol. The sample(s) may preferably be cleaned by bringing them into contact with a cleaning zone as described above during the addition of water/ethanol. The cleaning of the grinding/polishing sheet may also be performed by exposing the grinding/polishing sheet to ultrasonic cleaning.

BRIEF DESCRIPTION OF THE DRAWINGS

In the following, a number of preferred embodiment will be described with references to the drawings where.

DETAILED DESCRIPTION OF THE PREFERRED EMBODIMENT

Figure 1A:
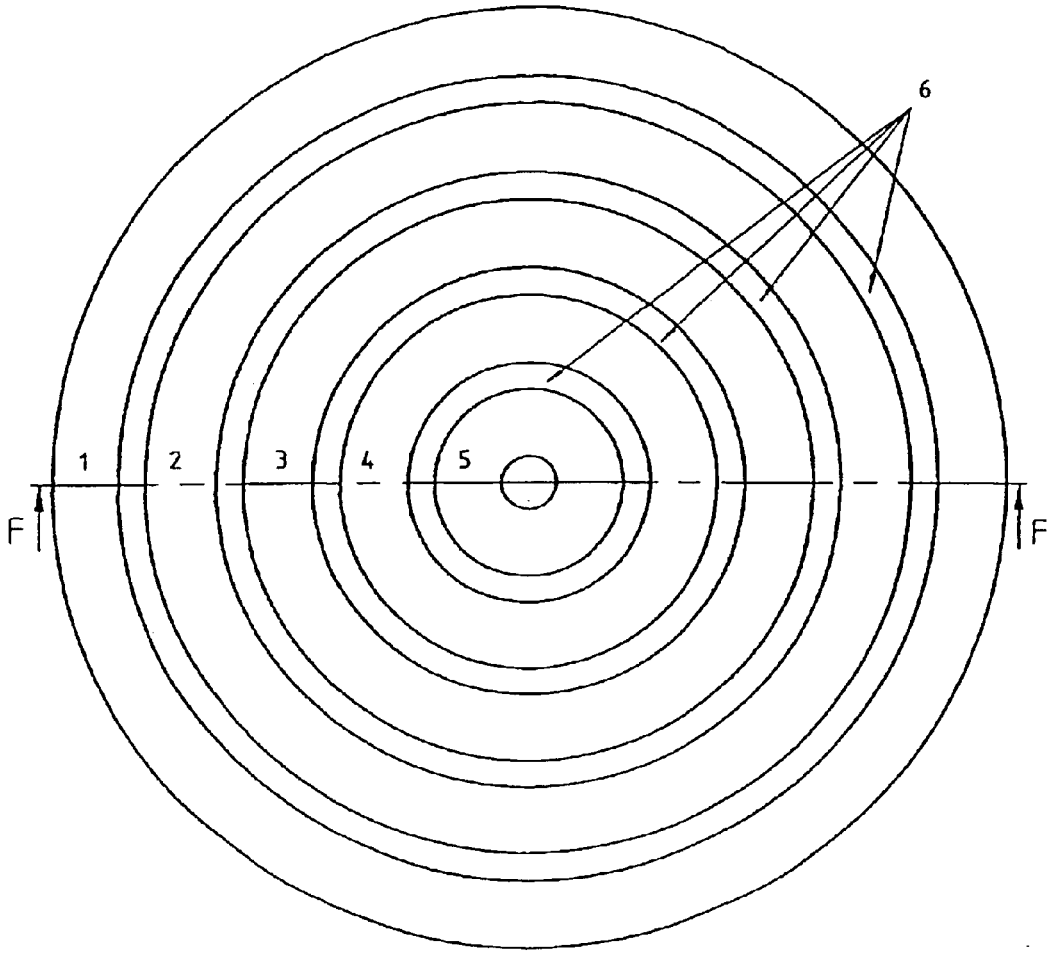
FIG. 1 shows the surface of a grinding/polishing sheet according to the invention.
Figure 1B:
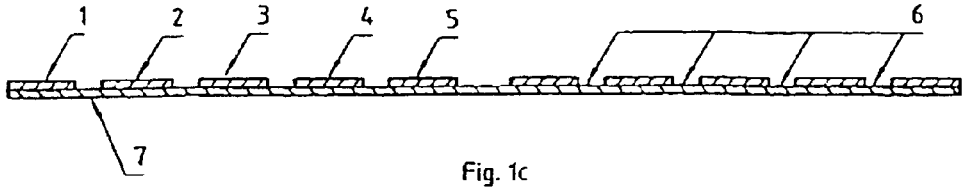
Figure 1C:
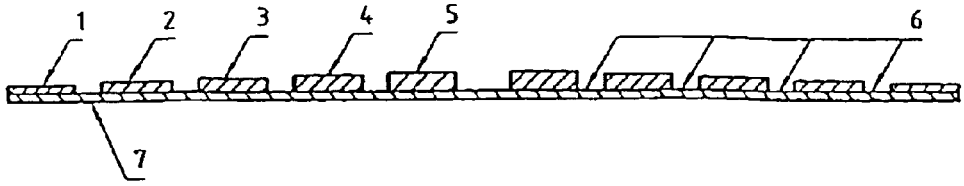

The grinding/polishing sheet seen from above in FIG. 1*a* has 5 grinding/polishing zones 1, 2, 3, 4, 5 and channels 6 between all of the zones. In FIGS. 1*b* and 1*c* the sheet is seen along the line FF'. In FIG. 1*b* all the grinding/polishing zones have the same height over the grinding/polishing sheet 7. In the embodiment shown in FIG. 1*c* the grinding/polishing zones have different heights over the grinding/polishing sheet, and the heights of the grinding/polishing zones increases towards the centre of the grinding/polishing sheet. For some purposes the embodiment of FIG. 1*c* has the advantage that it prevents the transport of grinding/polishing material and waste from one grinding/polishing zone to another more efficiently than embodiments with the zones in the same heights over the grinding/polishing sheet.

Figure 2:
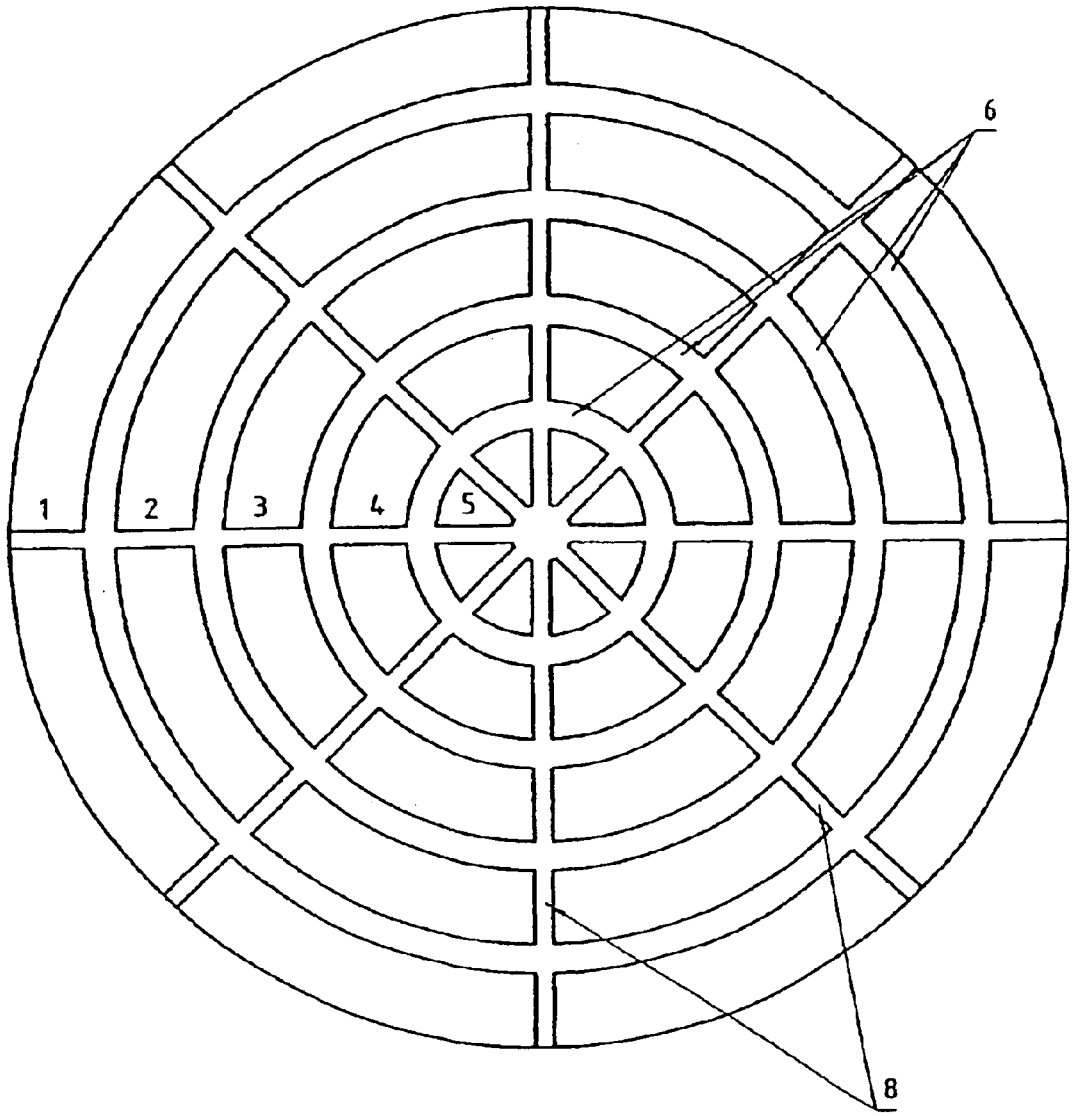
FIG. 2 shows an embodiment of the grinding/polishing sheet according to the invention with radial channels.
Figure 3:
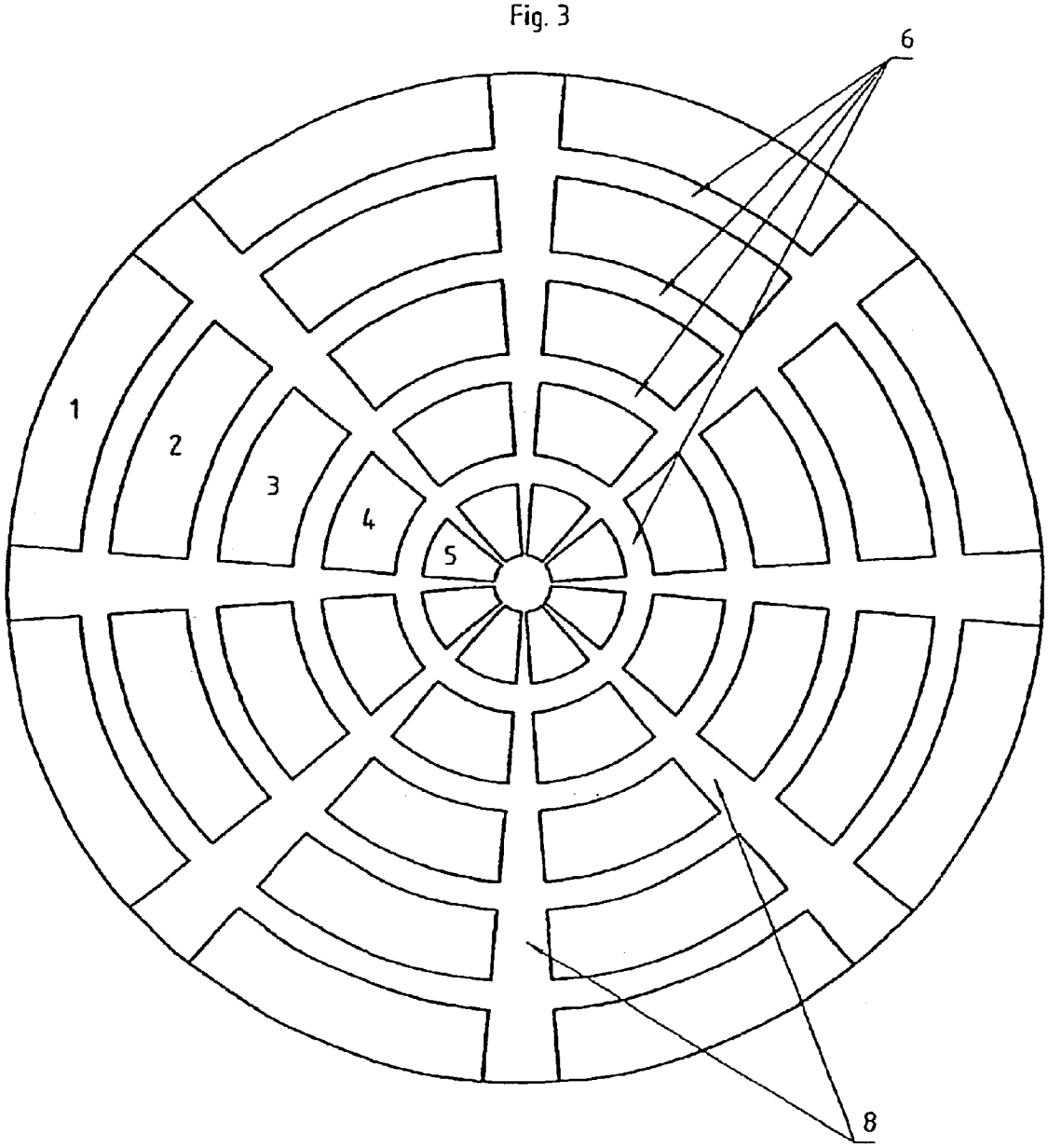
FIG. 3 shows an embodiment with alternative shape of radial channels.

In FIG. 2 and FIG. 3 embodiments with radial channels are seen. The sheets comprise grinding/polishing and/or cleaning zones 1, 2, 3, 4, 5 and annular channels 6 and furthermore radial channels 8.

Figure 4A:
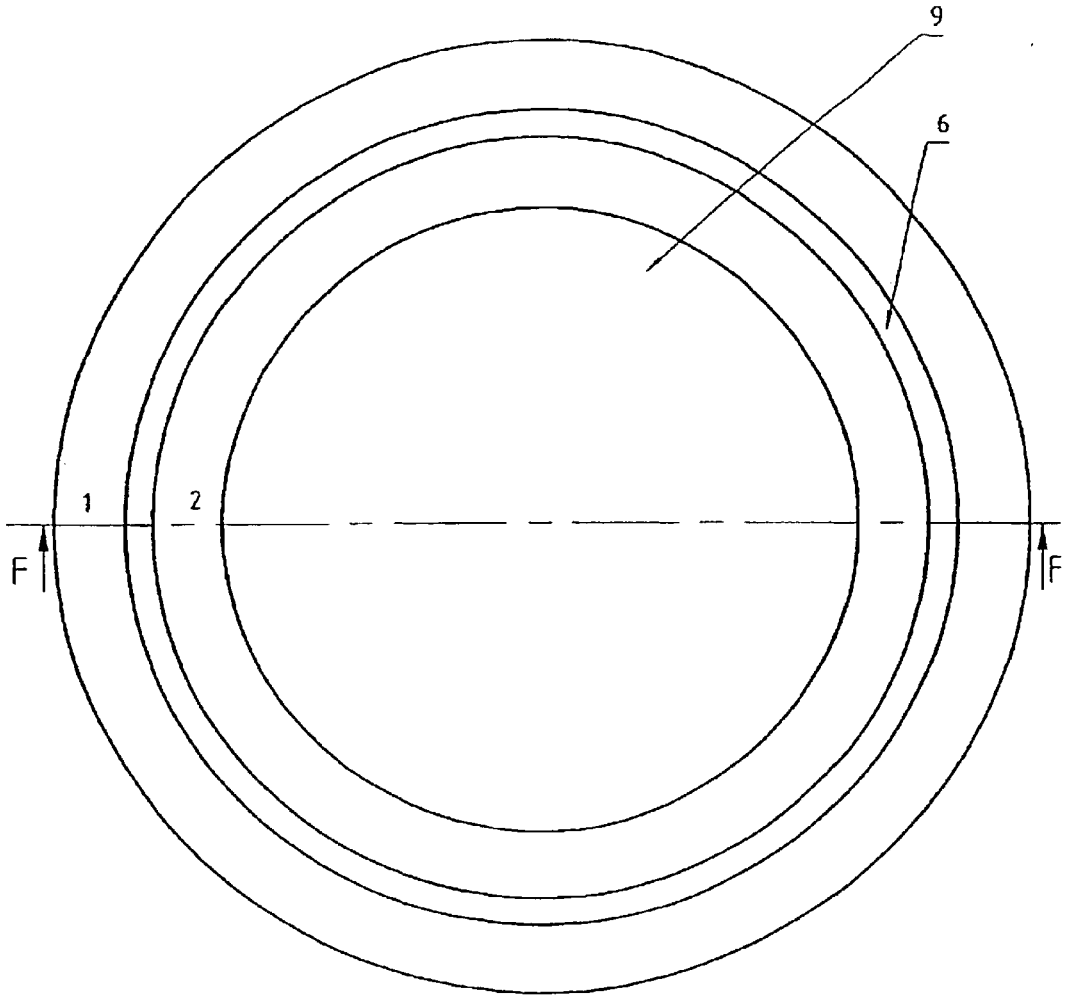
FIG. 4 shows an embodiment with releasable attached grinding/polishing zones.
Figure 4B:
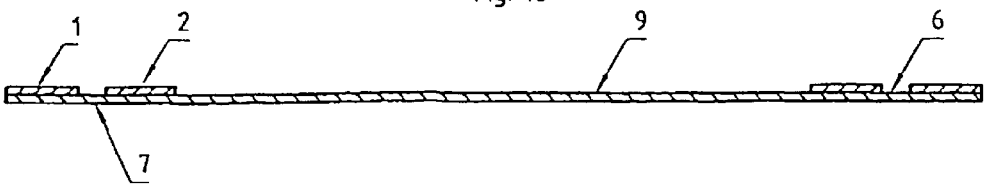

FIG. 4*a* shows a grinding/polishing sheet according to the invention with grinding/polishing zones 1, 2 having a channel 6 in between. In the central part of the sheet 9 the grinding/polishing zones can be releasable attached. FIG. 4*b* shows the sheet along the line FF'. The grinding/polishing zones are attached to the sheet 7.

Figure 5A:
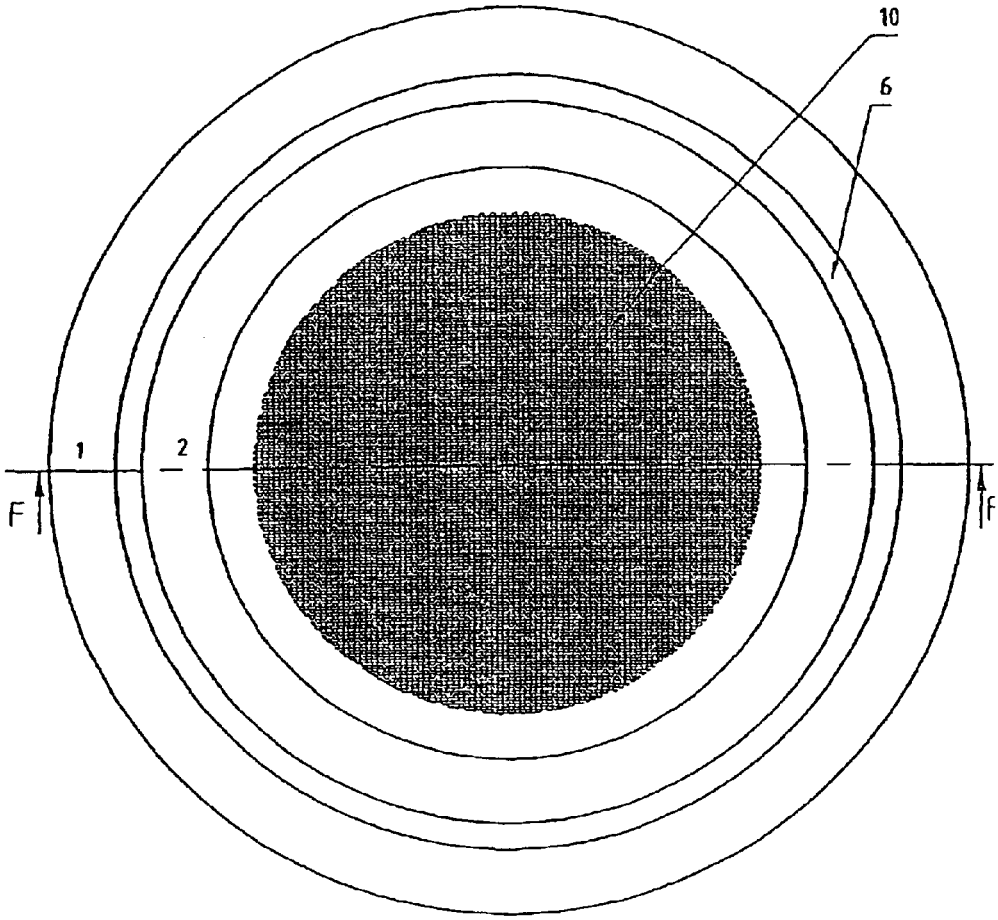
FIG. 5 shows an alternative embodiment with releasable attached grinding/polishing zones.
Figure 5B:
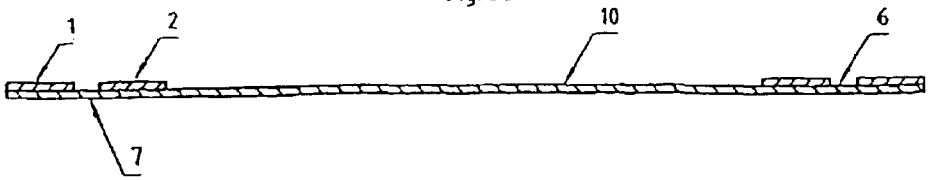

FIG. 5*a* shows an embodiment with grinding/polishing zones 1 and 2 with a channel 6 in between, where one or more zones can be releasable attached in the central area 10 on the sheet. The area 10 has a granulated surface in order to facilitate the release of attached zones. FIG. 5*b* shows the sheet along the line FF'.

Figure 6A:
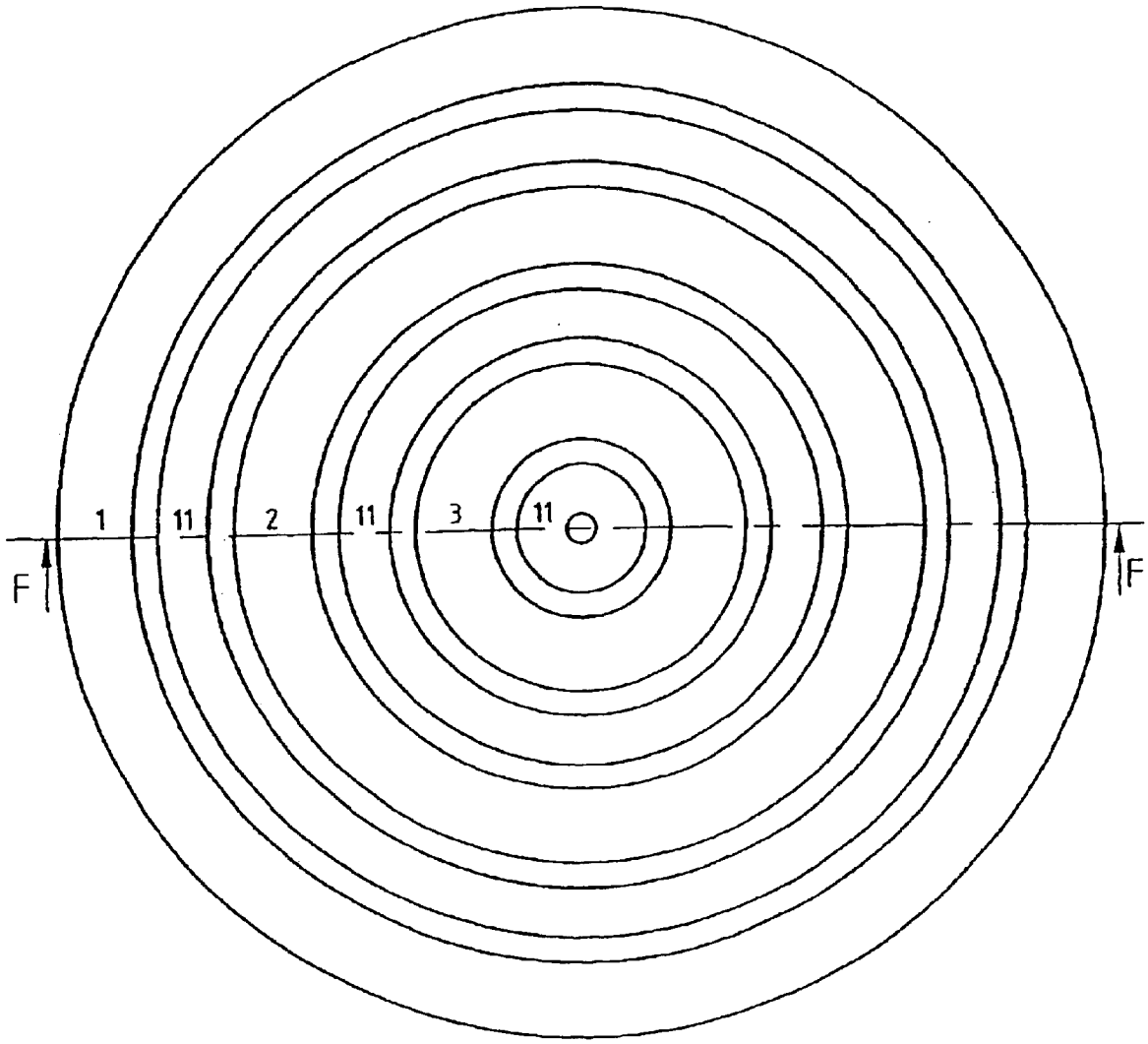
FIG. 6 shows a grinding/polishing sheet according to the invention with cleaning zones.
Figure 6B:
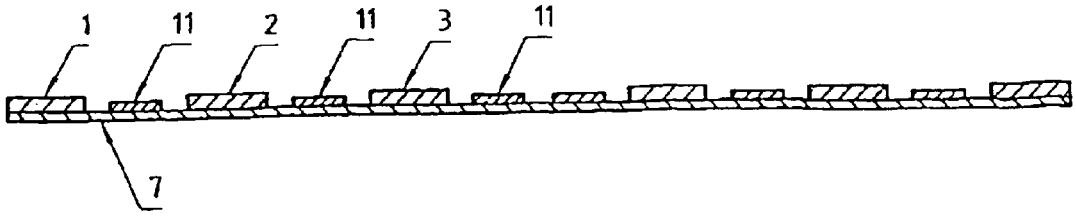

In FIG. 6*a* is seen a grinding/polishing sheet with grinding/polishing zones 1, 2, 3 and cleaning zones 11. The sheet of FIG. 6*a* is shown along the line FF' in FIG. 6*b*.

Figure 7A:
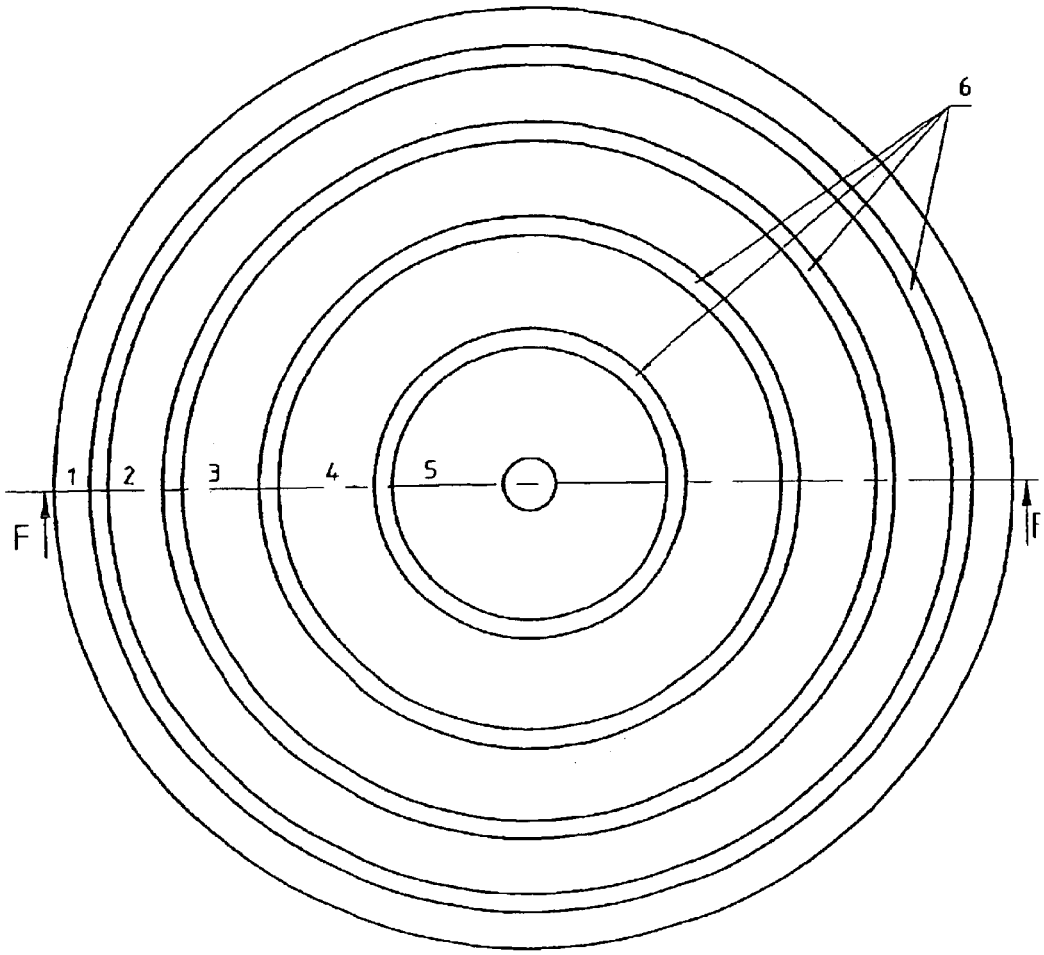
FIG. 7 shows an embodiment of the grinding/polishing sheet according to the invention.
Figure 7B:
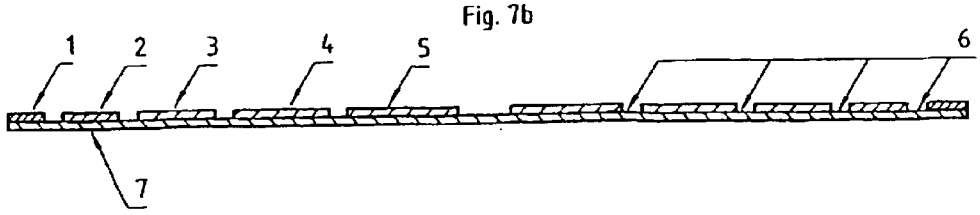

FIG. 7*a* and 7*b* shows an alternative embodiment of the grinding/polishing sheet according to the invention. The grinding/polishing sheet has grinding/polishing zones 1, 2, 3, 4 and 5 with channels 6 in between. The grinding/polishing zones 1, 2, 3, 4 and 5 have different widths. In the embodiment the width of the grinding/polishing zones increases towards the centre of the sheet e.g. to compensate for uneven wear on the zones.

Figure 8A:
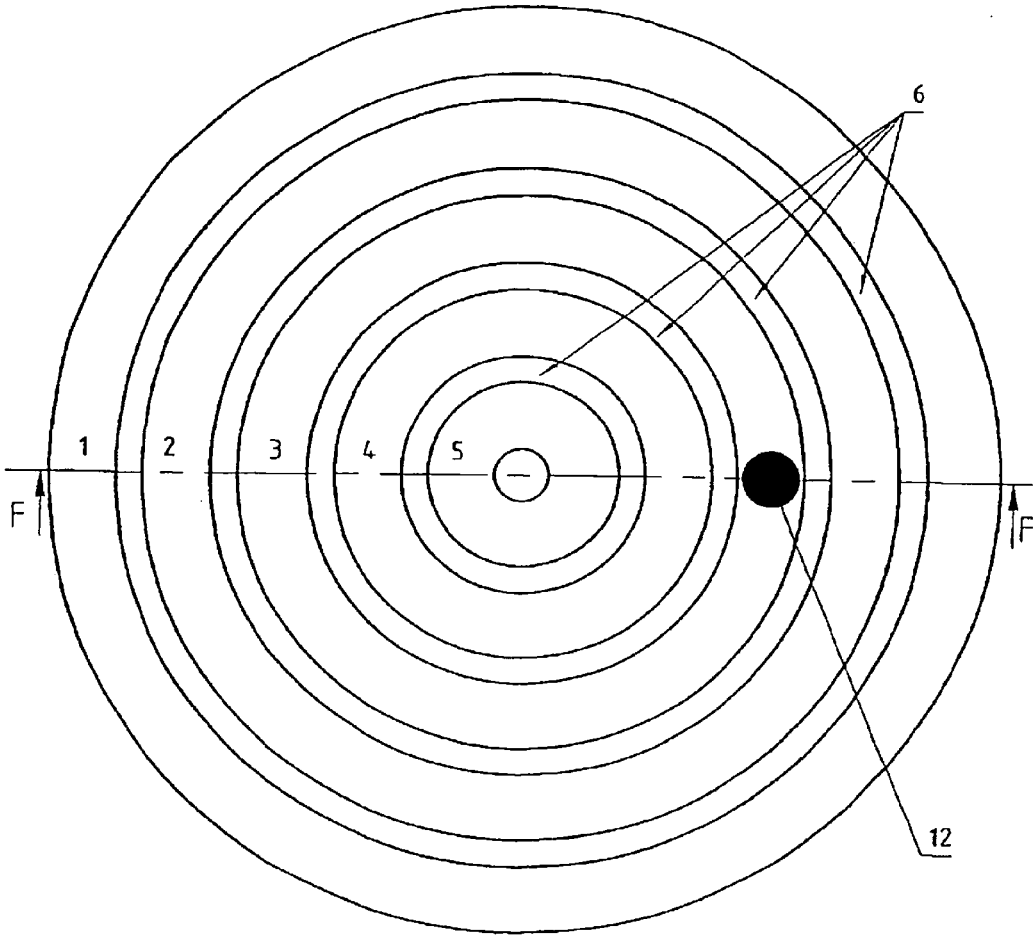
FIG. 8 shows a grinding/polishing sheet according to the invention with a sample.
Figure 8B:
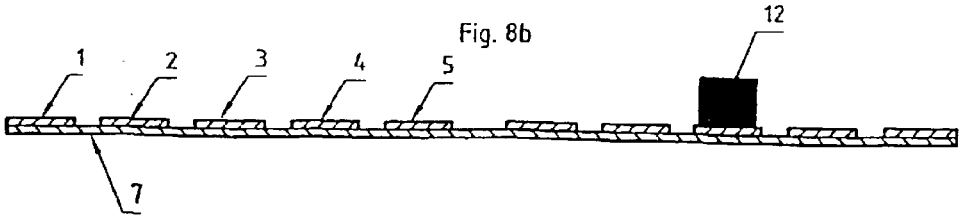

FIGS. 8*a* and 8*b* shows a grinding/polishing sheet according to the invention with grinding/polishing zones 1, 2, 3, 4 and 5 with channels 6 in between. The zones are attached to the sheet 7. On the grinding/polishing zone 3 a sample is 12 is placed. The sample 12 has a diameter, which is slightly smaller than the width of the grinding/polishing zone 3. Preferable the sample 12 is swept side to side (parallel to line FF') on the grinding/polishing zone in order to induce even wear on the grinding/polishing zone 3.

Figure 9:
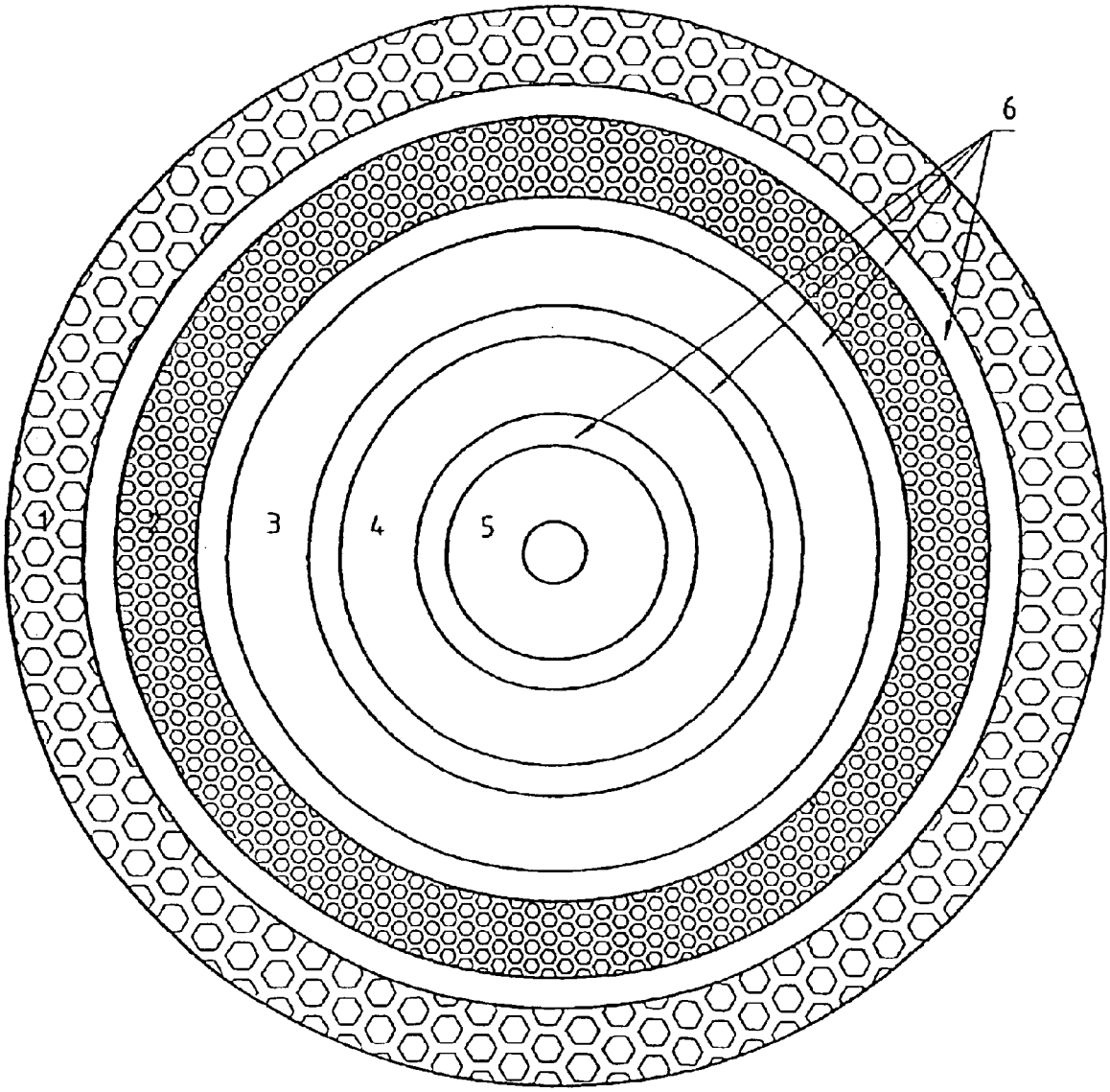
FIG. 9 shows a preferred embodiment of the grinding/polishing sheet according to the invention.

FIG. 9 shows a preferred embodiment of the grinding/polishing sheet according to the invention. The sheet comprises grinding/polishing zones 1, 2, 3, 4, 5 and channels 6 in between. A least a part of the grinding/polishing zones 1, 2 comprise a pattern.

As described above, the number of grinding/polishing zones may vary and furthermore, the cleaning zone is not essential. Since the grinding/polishing process preferably should be provided by starting grinding or polishing at the outermost grinding/polishing zone, followed by the second outermost grinding/polishing zone, the grain size incorporated to the zones or added thereto should gradually be reduced from the outermost zone to the innermost zone.

Particular preferred embodiments are described in the following:

A: A grinding/polishing sheet comprising 4 grinding/polishing zones, the first zone adapted for performing a plane grinding, and preferably comprising epoxy incorporated dimond/SiC grains having an average grain size between 60 and 80 $\mu$m. The second zone is adapted for performing a fine grinding, and preferably comprises epoxy incorporated diamond/SiC grains having an average grain size between 5 and 20 $\mu$m. The third zone is adapted for performing a polishing, and preferably comprises a textile whereto diamond grains of an average size between 2 and 4 $\mu$m is added prior to or during the polishing. The fourth zone is adapted for performing an oxide polishing, and preferably comprises a textile whereto oxide polishing agent is added prior to or during the oxide polishing.

B: The grinding/polishing sheet B is a variation of the grinding/polishing sheet A, wherein one or both of the grinding zones is replaced with composite material as described in WO 96/07508.

C: The grinding/polishing sheet C is a variation of the grinding/polishing sheet A or sheet B, further comprising a cleaning zone as the outermost zone on the sheet, adjacent to the first grinding zone.

D: The grinding/polishing sheet D is a variation of the grinding/polishing sheet A, B or sheet C further comprising one, two or three more grinding and/or polishing zones.

E: A grinding sheet comprising 3 to 6 grinding zones each comprising epoxy incorporated diamond/SiC grains, which in the outermost or first zone has an average grain size between 60 and 80 $\mu$m, and in the following zones having grains, which gradually decrease, towards the innermost zone.

F: The grinding sheet F is a variation of the grinding sheet E, wherein one or more of the grinding zones are replaced with composite material as described in WO 96/07508.

G: A polishing sheet comprising 2 to 6 polishing zones, each comprising a textile whereto diamond grains of an average size between 1 and 5 $\mu$m is added prior to or during the polishing. The grain size of the diamond gradually decreases from the outermost zone to the innermost zone.

H: The grinding sheet H is a variation of the grinding sheet G, wherein the innermost zone is replaced by an oxide polishing zone whereto oxide polishing agent is added prior to or during the oxide polishing.

I: The grinding/polishing sheet I is a variation of the sheets A, B, C, D, E, F, G or H, in which one or more areas on the sheet comprises a surface for temporary or releasable fixation of one or more self-sticking annular abrasive or polishing zones. The self-sticking annular zones may be changed to compensate for wear and thereby increase the lifetime of sheet I. Furthermore, the self-sticking annular zones may be changed to optimise the combination of grinding/polishing media for specific types of samples thereby making the sheet more flexible towards the type of sample.

J: The grinding/polishing sheet J is a variation of the sheets A, B, C, D, E, F, G or H in which one or more of the grinding/polishing zones sheet comprises an adhesive surface for temporary or releasable fixation of the annular abrasive or polishing zone. The annular grinding or polishing zones may be changed to compensate for wear thereby increasing the lifetime of sheet J. Furthermore, the annular zones may be changed to optimise the combination of grinding/polishing media for specific types of samples thereby making the sheet more flexible towards the type of sample.

What is claimed is:

1. A treating sheet for preparation of a materialographic sample or a set of materialographic samples, said sheet being substantially circular and having a back side and a face side, said face side comprising at least two annular treating zones, between said at least two treating zones said face side comprises intermediate annular distancing zones, each of said treating zones having a grinding or polishing surface, each distancing zone creating an annular channel between juxtaposed treating zones, wherein the entire radial width of each of said treating zones provides a contact surface, said treating zones have a width between 10 and 100 mm and wherein at least one of the annular channels between said treating zones has a depth measured from a lowest point of the channel to a plane defined by an upper surface of an adjacent treating zone, the adjacent treating zone lying next to the channel and closer to the center of the sheet than the channel between 0.1 and 3 mm.

2. A treating sheet according to claim 1, wherein said face side comprises between 2 and 6 annular treating zones.

3. A treating sheet according to claim 2, wherein said face side further comprises one or more cleaning zones.

4. A treating sheet according to claim 1, wherein at least one of the treating zones comprises at least one non-continuous area.

5. A treating sheet according to claim 4, wherein the at least one non-continuous area comprises discrete geometrical structures or the at least one non-continuous area is part of an annular structure forming channels in radial direction.

6. A treating sheet according to claim 5, wherein said discrete geometrical structures are polygons.

7. A treating sheet according to claim 1, wherein the width of each channel is at least 1 mm.

8. A treating sheet according to claim 7, wherein the width of said channels is between 2 and 20 mm.

9. A treating sheet according to claim 1, wherein the widths of the treating zones are substantially equal to each other.

10. A treating sheet according to claim 1, wherein at least one treating zone has a width different from the widths of other treating zones.

11. A treating sheet according to claim 1, wherein an outermost annular treating zone is a grinding zone by use of which a plane grinding step can be performed, said outermost annular treating zone comprising a grinding surface in the form of a surface layer having incorporated abrasive particles or in the form of a substrate for a grinding agent.

12. A treating sheet according to claim 11, wherein said face side comprises 2–6 annular treating zones, an innermost treating zone being a grinding zone by use of which a fine grinding step can be performed, said innermost treating zone comprising a grinding surface in the form of a surface layer having incorporated abrasive particles or in the form of a substrate for a grinding agent.

13. A treating sheet according to claim 11, wherein said face side comprises at least 3 annular treating zones, an innermost treating zone being a polishing zone by use of which a polishing step can be performed, said innermost treating zone comprising a polishing surface in the form of a surface layer constituting a substrate for a polishing agent.

14. A treating sheet according to claim 11, wherein said face side comprises a first grinding zone adapted for performing a plane grinding of one or more materialographic samples, a second grinding zone adapted for performing a fine grinding of at least one materialographic sample, a third zone adapted for performing a polishing of at least one materialographic sample, and a fourth zone adapted for performing a second polishing of at least one materialographic sample.

15. A treating sheet according to claim 1, wherein said face side comprises 2–6 annular treating zones, an outermost annular treating zone being a polishing zone by use of which a polishing step can be performed, an outermost zone comprising a polishing surface in the form of a surface layer constituting a substrate for a polishing agent.

16. A treating sheet according to claim 11, wherein an innermost annular treating zone is a polishing zone by use of which an oxide polishing step can be performed, said innermost zone comprising a polishing surface in the form of a surface layer constituting a substrate for an oxide polishing agent.

17. A treating sheet according to claim 1, wherein the sheet further comprises at least one cleaning zone, each treating zone has an associated cleaning zone in the form of the nearest annular channel towards the center of the grinding zone.

18. A treating sheet according to claim 11, wherein at least one of the treating zones is releasably attached to the treating sheet.

19. A treating sheet according to claim 18, wherein at least one of the treating zones is releasably attached to the treating sheet by use of an adhesive layer, hooks and loops, magnetic force, screws, pins, clips, press studs or vacuum.

20. A treating sheet according to claim 19, wherein each of the treating zones has a layer of adhesive applied to a side facing the face side of the treating sheet.

21. A treating sheet according to claim 19, wherein a layer of adhesive is applied to all or a part of the face side of the treating sheet.

22. A treating sheet according to claim 21, wherein the layer of adhesive is coated with a cover lining.

23. A treating sheet according to claim 1, wherein said treating zones have a width of between 15 and 50 mm.

24. A treating sheet according to claim 1, wherein the depth of said at least one of the annular channels is between 0.5 and 2 mm.

25. A treating sheet according to claim 12, wherein said face side comprises between 2 and 3 annular treating zones.

26. A method of treating a materialographic sample which comprises the steps of:

(a) providing a rotatable disc, (b) mounting a treatment sheet on the rotatable disc, said treatment sheet having an exposed face with an outer annular treatment area, an inner annular treatment area, and an annular channel therebetween, one of said outer and inner annular treatment areas containing grinding grains of a certain average grain size, (c) rotating said rotatable disc and said treatment sheet thereon, (d) applying a lubricant to the face of said treatment sheet, (e) contacting a materialographic sample with first said outer annular treatment area and then said inner annular treatment area of said treatment sheet such that said materialographic sample contacts the entirety of both said outer and inner annular areas, and (f) collecting loosening grains of said grinding grains within said annular channel.

27. The method according to claim 26, wherein each of said outer and inner annular treatment areas has a width between 10 and 100 mm.

28. The method according to claim 27, wherein the materialographic sample respectively extends across the entire width of the inner annular treatment area and thereafter across the entire width of the outer annular treatment area of the outer annular treatment area.

29. The method according to claim 27, wherein the materialographic sample, in order to contact the entirety of the outer and inner annular areas, is moved radially outwardly relative to the rotating treatment sheet.

* * * * *